US007882907B2

(12) United States Patent
Engstrom

(10) Patent No.: US 7,882,907 B2
(45) Date of Patent: Feb. 8, 2011

(54) EARTH BORING BIT

(76) Inventor: Robert W. Engstrom, P.O. Box 1659, Gillette, WY (US) 82717

( * ) Notice: Subject to any disclaimer, the term of this patent is extended or adjusted under 35 U.S.C. 154(b) by 314 days.

(21) Appl. No.: 12/223,160

(22) PCT Filed: Oct. 11, 2007

(86) PCT No.: PCT/US2007/021712

§ 371 (c)(1),
(2), (4) Date: Jul. 24, 2008

(87) PCT Pub. No.: WO2008/069863

PCT Pub. Date: Jun. 12, 2008

(65) Prior Publication Data

US 2010/0230175 A1 Sep. 16, 2010

(51) Int. Cl.
*E21B 10/42* (2006.01)

(52) U.S. Cl. ..... 175/391; 175/413

(58) Field of Classification Search ..... 175/391, 175/413, 421, 427

See application file for complete search history.

(56) References Cited

U.S. PATENT DOCUMENTS 2,044,303 A 6/1936 Howard
4,386,422 A 5/1983 Mumby et al.
5,735,360 A * 4/1998 Engstrom ..... 175/391
5,880,382 A 3/1999 Fang et al.
6,918,455 B2 7/2005 Meyers et al.
2005/0145417 A1 7/2005 Radford et al.
2009/0057030 A1 * 3/2009 Didericksen et al. ..... 175/401

* cited by examiner

*Primary Examiner*—William P Neuder
(74) *Attorney, Agent, or Firm*—Richard C. Litman

(57) ABSTRACT

The earth boring bit 10 is designed to bore an angular non-vertical hole into underlying strata. The bit 10 includes a plurality of steeply inclined cutting faces or edges 22 that define a relatively narrow included angle A therebetween. The bit's design ensures that the apex of the bit 10 will contact the surface S and/or other hard strata before the radially outwardly disposed gauge portion of the bit 10. This design reduces or obviates drill chattering or "walking" when the bit 10 is used to drill a hole at an angle that is not vertical relative to the surface or strata S. The bit 10 also includes an interchangeable flow control restrictor that optimizes the velocity of fluid pumped through the bit 10 and thus efficiently flushes debris from the hole as the hole is being drilled.

19 Claims, 4 Drawing Sheets

EARTH BORING BIT

TECHNICAL FIELD

The present invention relates generally to drill bits for mining operations and drilling into rock formations, and more specifically to an earth boring bit having a plurality of teeth for boring into the earth.

BACKGROUND ART

Earth boring bits are used in a number of different fields and applications, from drilling gas, oil, and water wells to various applications in the mining industry. One area in which earth boring drills are commonly used is in the formation of blasting holes for the insertion of explosives therein, for removing overburden in mining operations. This is particularly the case in open pit mining, where the loosened overburden is removed by means of dragline machines. Accordingly, one of the goals when blasting away the overburden is to throw or cast the material away from the mining face, where it can be more easily removed by the dragline process.

To accomplish the task of efficiently casting the overburden material away from the working face of the operation where it can be easily removed by the dragline bucket, the explosives set for blasting the overburden material away should be set or planted in a relatively precise pattern. This is achieved by drilling a series of blast holes into the overburden material, with the holes formed at an angle to the working face and converging toward an apex within the overburden material. The simultaneous detonation of explosives set within such a blast hole formation throws or casts the overburden material outwardly away from the working face of the operation where the cast away overburden material may be easily and efficiently removed by means of a dragline machine.

However, most earth boring drill bits are not optimally configured for drilling bore holes at an angle to the surface or to the rock or other hard strata beneath the surface. Most such bits have relatively shallowly inclined cutting faces, i.e., a large, obtuse included angle to the faces. This results in the outer edge or gauge portion of the bit making the first contact with the surface or stratum being drilled, with the result being the chattering or "walking" of the drill bit until it penetrates the surface or stratum. This is particularly hard on equipment, with the undue stress leading to damaged and broken bits, teeth, drill stems, and other equipment. This is not a small matter, as such earth boring bits can cost several thousand dollars to replace, and may require considerable labor to extract from a bore hole if the problem occurs in a stratum relatively deep within the hole.

Such earth boring drills conventionally remove the debris from the bore hole by applying a fluid (e.g., air) down the drill stem where it passes through the drill bit and blows or carries the loose material past the outside of the drill bit and stem out of the hole. Air is conventionally used for this purpose in mining operations, with the air being supplied by a compressor. It will be appreciated that the airflow at the drill head will be dependent upon the size and output of the compressor, as well as the internal diameter of the drill stem and passages through the drill bit or head. A compressor which is not capable of providing sufficient flow to create a relatively high velocity at the drill head cannot remove the loosened material from the bore hole, which may result in the jamming of the bit and stem in the hole. As in the problems noted above with broken bits and drill stems, the problems associated with inefficient removal of material from the bore hole can result in considerable expense and labor to correct.

Thus, an earth boring bit solving the aforementioned problems is desired.

DISCLOSURE OF INVENTION

The disclosure is directed to an earth boring bit. The bit has a body with a drill stem attachment end and a working end opposite the drill stem attachment end. A fluid passage is defined within the body of the bit. The fluid passage is formed axially and substantially concentrically through the body of the drill bit. A plurality of radially disposed cutting faces extends from the body of the bit. A working edge is disposed along each of the cutting faces so that the working edges collectively define an included angle of up to ninety degrees. Cutting tooth sockets are disposed along each of the working edges of the cutting faces. Each of the cutting tooth sockets define a cutting tooth angle relative to the cutting face to which the socket is attached. A cutting tooth is removably installed within each of the cutting tooth sockets and a selectively replaceable fluid control restrictor is removably installed within the fluid passage.

BRIEF DESCRIPTION OF THE DRAWINGS

Similar reference characters denote corresponding features consistently throughout the attached drawings.

BEST MODES FOR CARRYING OUT THE INVENTION

The present invention is directed to an earth boring bit. The bit may have either or both of two features that improve the efficiency and reliability and reduce damage to such devices. The first feature comprises a bit having relatively steeply angled cutting faces so that the apex of the bit makes initial contact with the surface and/or any underlying hard strata when the bit is driven at other than a vertical angle to the surface or strata. The individual teeth of the bit are preferably set at an angle along each cutting edge or face, which optimizes their cutting efficiency and reduces lateral forces thereon when encountering a surface or stratum at other than the vertical.

The second feature includes an interchangeable flow control orifice therein, wherein a restrictor having a relatively small orifice may be installed when a relatively small compressor is used, in order to produce sufficient flow velocity through the drill head to flush or blow out loosened material in the hole. The size of the orifice is easily changed when the drill bit is removed from its drill stem.

Figure 1:
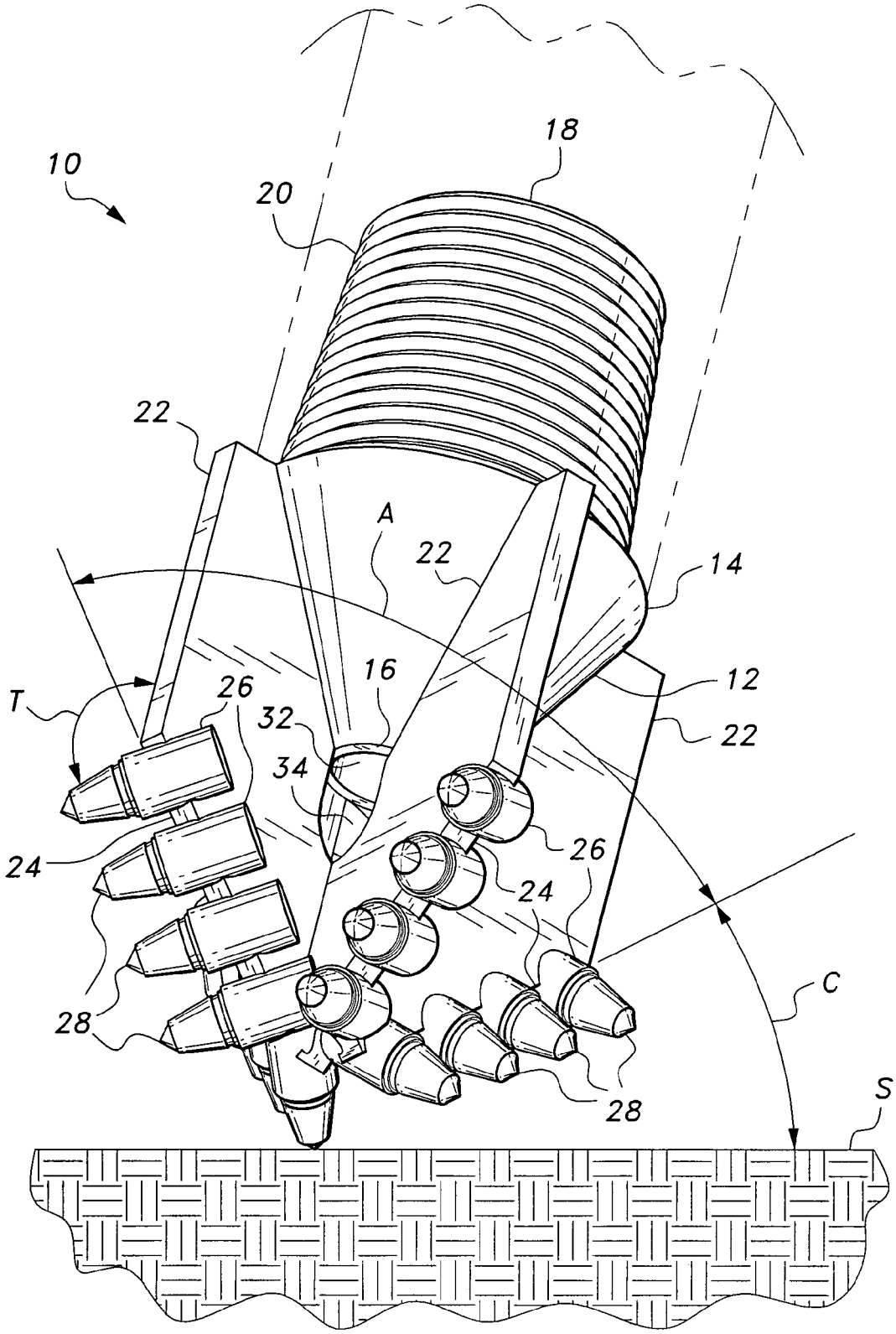
FIG. 1 is an environmental, perspective view of an earth boring bit according to the present invention, with the bit having a narrow included angle for angle drilling.

FIG. 1 of the drawings provides an environmental perspective view of an earth boring bit 10 having relatively steeply angled cutting faces so that the apex of the bit makes initial contact with the surface and/or any underlying hard strata when the bit is driven at other than a vertical angle to the surface or strata. The bit 10 includes a truncated, generally conical body portion 12 having a relatively wide base 14 and a relatively narrow working end 16 opposite the base 14. A drill stem attachment end 18 extends from the base 14, with the stem attachment end 18 including a tapered, externally threaded portion 20 for removable attachment to a drill stem or the like.

A series of radially disposed cutting faces or wings 22 extend outwardly from the conical body 12. Each of the faces 22 has a working edge 24, with each of the edges 24 forming an acute angle relative to the axial centerline of the bit 10. Each working edge 24 includes a series of cutting tooth sockets 26 disposed therealong, with each of the sockets 26 having a cutting tooth 28 removably installed therein. The cutting teeth 28 may be punched or pressed out of the sockets 26 when worn or broken, with new replacement teeth being pressed into the sockets 26 as needed.

The earth boring bit 10 is configured for efficiently starting or drilling a hole at some acute angle to the surface or strata, with the working edges 24 of the cutting faces 22 and their respective rows of tooth sockets 26 and teeth 28 collectively forming an included angle A (similar to the point angle of a twist drill bit) of no more than ninety degrees (when the bit is rotated about its axis, the working edges 24 define a right circular cone; the included angle A is defined by a plane extending through the height of the cone, in particular, by the opposing slant heights at the intersection of the plane with the cone). The included angle A may be an acute angle of less than ninety degrees, if so desired. By configuring the bit 10 to have such a relatively narrow included angle for its cutting elements, the bit 10 may be inclined at some acute angle relative to the surface S without initially engaging the outer or gauge teeth 28 with the surface as the drilling operation begins, generally as shown in FIG. 1 of the drawings.

The narrow included angle A of the working elements of the bit 10 results in the centermost or apex cutting teeth 28 first engaging the surface when the bit 10 is inclined at some acute angle. This ensures that the bit 10 will not tend to chatter or "walk," i.e., drift from the intended location from the hole as the hole is started. Preferably, the included angle A for the bit 10 is formed to provide a clearance angle C between the surface S or strata and the working edges 24 of the faces 22 (and their rows of cutting teeth 28) on the order of twenty degrees, depending upon the angle from the vertical desired for the hole to be drilled.

Figure 2A:
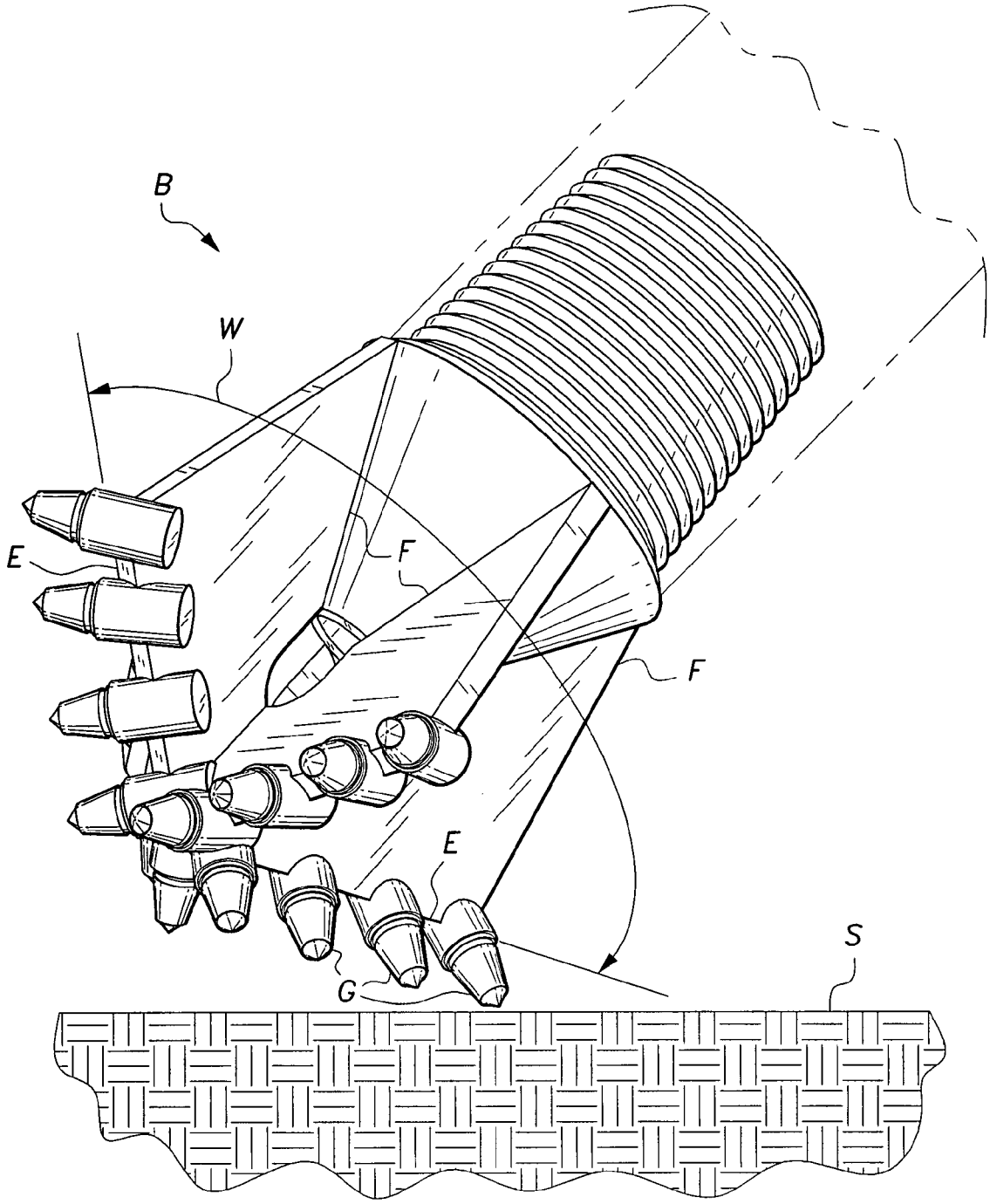
Fig. 2A (PRIOR ART)
FIG. 2A is an environmental perspective view of a prior art earth boring bit having a shallow and wide included angle, illustrating the problem of drilling at an acute angle to the surface when using such a bit.

In contrast, the conventional claw-type earth boring bit B has a somewhat shallower or wider included angle W, as shown in prior art FIG. 2A. This wide included angle W is generally on the order of about 140 degrees, i.e., the working edge E of each of the cutting faces F is swept back only about twenty degrees from a line normal to the rotary axis of the bit B. This results in the gauge teeth G, and particularly the outermost gauge teeth, contacting the surface S before the apex teeth when the bit B is inclined at an angle no greater than twenty degrees from vertical to the surface S. Accordingly, the conventional drill bit B will tend to chatter or "walk" when initially contacting the surface S under such conditions.

Figure 2B:
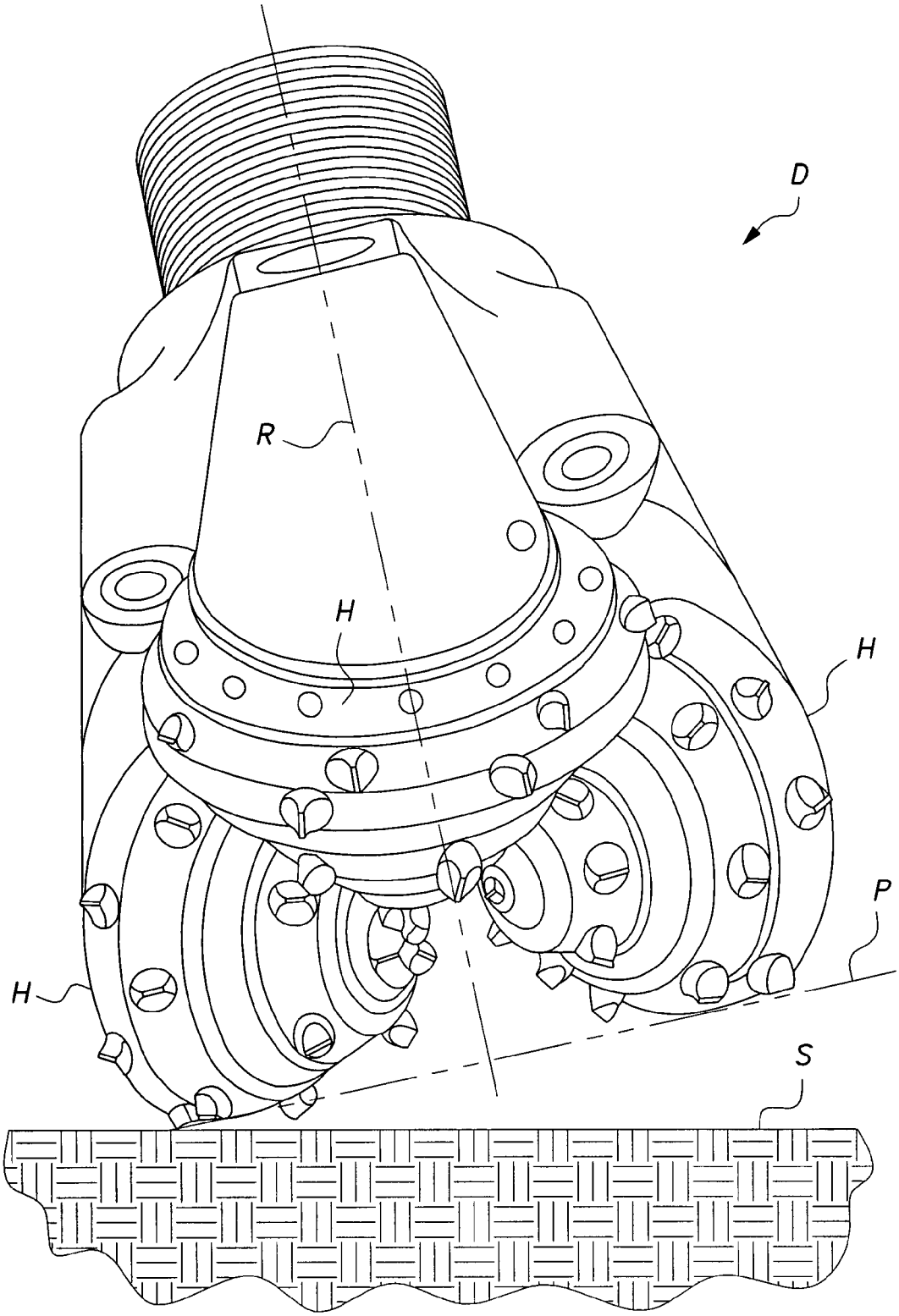
Fig. 2B (PRIOR ART)
FIG. 2B is an environmental perspective view of a prior art triconical earth boring bit with the conical elements defining a cutting plane normal to the axis of the drill string, illustrating the problem of drilling at an acute angle to the surface when using such a bit.

FIG. 2B illustrates the problem of attempting to drill or bore a hole at an angle other than normal to the surface S, when using a triconical type earth boring bit D. Such triconical bits D include a series of three independently rotating conical elements H, with the lowermost points of tangency of these conical elements H defining a plane P normal to the rotary axis R of the drill bit and drill string. It will be seen that if the rotary axis R is at an angle other than normal to the surface or stratum S, that the cutting plane (essentially defining an included or point angle of 180 degrees, or a flat plane) will also be at an equal angle relative to the surface or stratum S. Thus, such rotary conical element drill bits D are even more susceptible to chattering or walking when starting a hole, than are the claw type bits B as exemplified in FIG. 2A.

It will be appreciated that the angle of the drill bit relative to the surface need not place the outer or gauge teeth in contact with the surface before the apex teeth, in order to produce the chattering and walking problems noted above. Even if the apex teeth contact the surface first, if the gauge teeth contact the surface before the apex teeth have penetrated sufficiently deeply, the drill will still tend to chatter or walk. Thus, it is preferred that the included angle A of the bit 10 be sufficient to provide a clearance angle C of at least twenty degrees, as shown in FIG. 1 of the drawings, in order to preclude chattering and walking of the drill during angle drill operations. In general, the user will know the desired angle of the bit 10 relative to the work surface S; therefore, he selects a bit having the desired included angle A that will result in a sufficient clearance angle C.

It will be seen that when drilling at an angle significantly less than normal to the surface, that the cutting teeth will have a less than optimum contact angle relative to the surface. Accordingly, the earth boring bit 10 of FIG. 1 may incline the axes of the cutting tooth sockets 26 at an appropriate cutting tooth angle T in order for the teeth 28 to engage the surface S at an optimum angle (cutting tooth angle T is generally defined between the socket 26 and the face of the wing or cutting face 22; the cutting tooth angle T for each socket 26 in the same row may be the same angle or a different angle). This optimum angle is on the order of forty-five degrees, but may vary somewhat to either side of that angle. Thus, it will be seen that the earth boring bit 10 may be optimized for drilling at specific angles to the surface (or underlying strata), by configuring both the included angle A of the leading or working edges 24 of the cutting faces 22 and the attachment angle T of the tooth sockets 28 and their concentric teeth 28 to correspond with the desired drilling angle.

Figure 3:
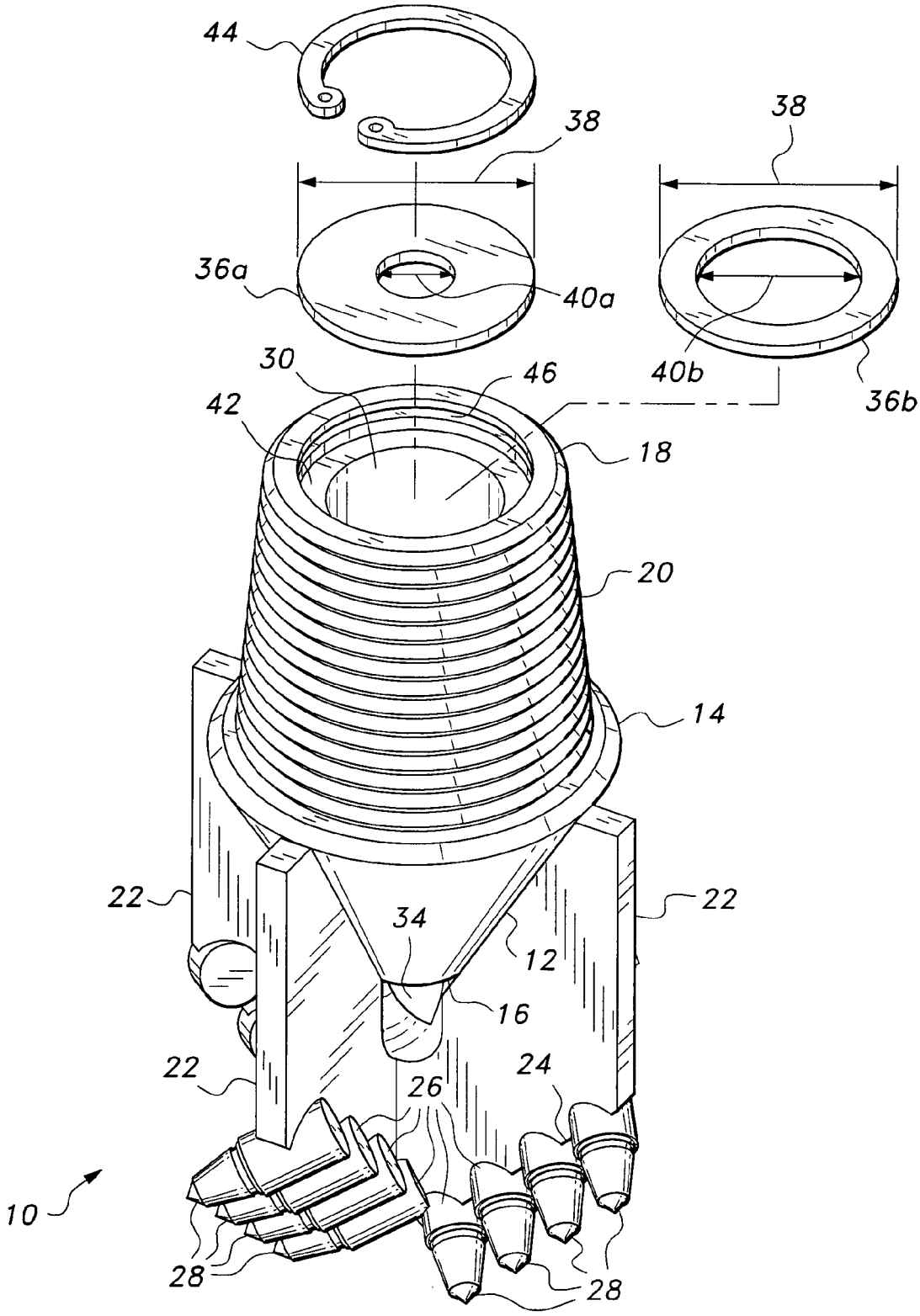
FIG. 3 is an exploded view of an earth boring bit according to the present invention having interchangeable flow control orifices therewith.

FIG. 3 of the drawings provides an internal view of the drill stem attachment end 18 of the earth boring bit 10. The bit 10 includes a fluid passage 30 extending axially and concentrically through the body portion 12 and threaded portion 20, for conveying a fluid from the hollow drill stem through the bit 10 to flush debris from the hole being drilled during drilling operations. The fluid enters the fluid passage 30 at the open drill stem attachment end 18 of the body and passes through the fluid passage 30, exiting at the opening 32 at the narrower working end 16 of the conical body portion 12, shown in FIG. 1. Each of the cutting faces 22 includes an internally disposed relief area therein, with the relief areas of the cutting faces defining a fluid outlet opening 34 which communicates with the outlet 32 of the conical body to allow fluid to flow outwardly past the cutting faces 22.

Conventionally, the fluid is air, which is pumped under pressure through the hollow drill stem and through the drill bit, to blow loose debris from the bottom of the hole as it is being drilled. Alternatively, other gases or a liquid (e.g., water, drilling "mud," etc.) may be used to flush debris from the hole. When air is used as the flushing agent, the air is conventionally supplied by a compressor. It will be seen that the volume and velocity of air through the bit, and thus the effectiveness of the debris flushing or dispersal action within the hole being drilled, are dependent upon the size and capacity of the compressor and the diameter of the fluid passage through the bit, among other considerations. A relatively large diameter bit in combination with a relatively small capacity compressor will result in relatively low airflow through the bit and correspondingly poor removal of debris from the hole.

The bit 10 incorporates a mechanism to control the velocity of the airflow through the internal fluid passage 30, comprising a selectively replaceable fluid control restrictor removably installed within the fluid passage. Examples of two such alternate restrictors 36*a* and 36*b* are illustrated in FIG. 3. The restrictors preferably comprise flat, relatively thin discs having flow control passages formed concentrically therethrough, in the manner of a washer or the like. Any of the restrictors used with the bit 10 have identical outer diameters 38, but the diameters of the internal flow control passages may vary as desired, e.g., the smaller flow control passage 40*a* of the first washer 36*a* and the larger passage 40*b* of the second washer 36*b*.

In the case of a relatively low volume compressor being used to supply the airflow to the bit 10, a flow control washer 36*a* having a relatively small diameter internal passage 40*a* may be used. This results in the airflow (or other fluid, as desired) being accelerated as it passes through the relatively narrow opening or passage 40*a*, with the higher velocity having relatively greater kinetic energy to blow debris from the working end of the bit. The debris is blown back along the sides and edges of the bit 10, along the outside of the drill stem and out of the hole. Where a relatively high volume compressor is used, particularly in combination with a relatively small diameter drill bit 10, it will not be necessary to narrow the flow passage through the bit. In this instance, a flow control washer 36*b* having a relatively large diameter internal flow control passage 40*b*, may be installed. The velocity of the fluid flow from the compressor will remain relatively high throughout the entire drill stem and through the bit 10 in such a case, thereby removing the need to restrict the flow through the drill bit.

It will be seen that flow control washers having virtually any practicable internal diameter for the flow control passage may be provided as desired or required. The two examples shown in FIG. 3 represent washers having internal flow control diameters approaching the extremes in each direction, with it being possible to provide any number of washers having intermediate internal diameters between those depicted in FIG. 3. The washers are easily installed within a seat 42 in the drill stem attachment end 18 of the body with its flow control passage 30, and are retained by an internal snap ring 44 which seats within a peripheral groove 46 surrounding the seat 42 of the flow control passage 30.

In conclusion, the earth boring bit may include various features that facilitate the task of boring holes in the earth for mining or other purposes. The bit may have faces at an acute angle that greatly facilitates the boring of holes at other than a ninety degree angle to the surface or underlying strata. This is an important consideration when drilling blasting holes for explosives, when the overburden is to be cast from the working face by the force of the blast. Alternatively, or in addition to the acute angle of the faces, the bit may have interchangeable flow control orifices, which maximizes the efficiency of the air or other fluid supplied through the drill stem and bit to blow out debris from the hole during the drilling operation. The acute face and cutting angle of the bit may be used with or without the flow control orifice feature, and/or the selectively installable flow control orifices may be provided in a drill bit having conventional face or cutting angles, as desired. In any event, the earth boring bit will prove to be a most valuable tool in the mining and other earth boring fields.

It is to be understood that the present invention is not limited to the embodiments described above, but encompasses any and all embodiments within the scope of the following claims.

The invention claimed is:

1. An earth boring bit, comprising:

a body having a drill stem attachment end and a working end opposite the attachment end, the body defining a fluid passage formed axially and substantially concentrically therethrough;

a plurality of radially disposed cutting faces extending from the body;

a working edge disposed along each of the cutting faces, the working edges collectively defining an included angle of up to ninety degrees;

a plurality of cutting tooth sockets disposed along each of the working edges of the cutting faces, each of the cutting tooth sockets defining a cutting tooth angle relative to the cutting face to which the socket is attached;

a cutting tooth removably installed within each of the cutting tooth sockets; and a selectively replaceable fluid control restrictor removably installed within the fluid passage.

2. The earth boring bit according to claim 1, wherein the body has a truncated conical configuration having a wide base adjacent the drill stem attachment end thereof.

3. The earth boring bit according to claim 1, wherein the drill stem attachment end of the body is externally taper threaded.

4. The earth boring bit according to claim 1, wherein the cutting faces collectively define an opening therebetween communicating with the fluid passage of the body.

5. The earth boring bit according to claim 1, wherein the fluid control restrictor comprises a flat disc having a flow control passage formed concentrically therethrough.

6. The earth boring bit according to claim 1, further including a fluid control restrictor retainer, the restrictor retainer being an internal snap ring removably disposed within the flow control passage adjacent the flow control restrictor.

7. An earth boring bit, comprising:

a body having a drill stem attachment end and a working end opposite the attachment end;

a plurality of radially disposed cutting faces extending from the body;

a working edge disposed along each of the cutting faces, the working edges collectively defining an included angle of up to ninety degrees;

a plurality of cutting tooth sockets disposed along each of the working edges of the cutting faces, each of the cutting tooth sockets defining a cutting tooth angle relative to the cutting face to which the socket is attached; and a cutting tooth removably installed within each of the cutting tooth sockets.

8. The earth boring bit according to claim 7, wherein the body has a truncated conical configuration having a wide base adjacent the drill stem attachment end thereof.

9. The earth boring bit according to claim 7, wherein the drill stem attachment end of the body is externally taper threaded.

10. The earth boring bit according to claim 7, wherein the body has a fluid passage formed axially and substantially concentrically therethrough, the earth boring bit further comprising a selectively replaceable fluid control restrictor removably installed within the fluid passage.

11. The earth boring bit according to claim 10, wherein the cutting faces collectively define an opening therebetween communicating with the fluid passage of the body.

12. The earth boring bit according to claim 10, wherein the fluid control restrictor comprises a flat disc having a flow control passage formed concentrically therethrough.

13. The earth boring bit according to claim 10, further including a fluid control restrictor retainer, the restrictor retainer being an internal snap ring removably disposed within the flow control passage adjacent the flow control restrictor.

14. An earth boring bit, comprising:

a body having a drill stem attachment end and a working end opposite the attachment end, the body defining a fluid passage formed axially and substantially concentrically therethrough;

a selectively replaceable fluid control restrictor removably installed within the fluid passage; and a fluid control restrictor retainer, the restrictor retainer being an internal snap ring removably disposed within the flow control passage adjacent the flow control restrictor.

15. The earth boring bit according to claim 14, wherein the fluid control restrictor comprises a flat disc having a flow control passage formed concentrically therethrough.

16. The earth boring bit according to claim 14, further including:

a plurality of radially disposed cutting faces extending from the body;

a working edge disposed along each of the cutting faces, the working edges collectively defining an included angle of no more than ninety degrees;

a plurality of cutting tooth sockets disposed along each of the working edges of the cutting faces, each of the cutting tooth sockets defining a cutting tooth angle relative to the respective cutting face; and a cutting tooth removably installed within each of the cutting tooth sockets.

17. The earth boring bit according to claim 16, wherein the body has a truncated conical configuration having a wide base adjacent the drill stem attachment end thereof.

18. The earth boring bit according to claim 16, wherein the drill stem attachment end of the body is externally taper threaded.

19. The earth boring bit according to claim 16, wherein the cutting faces collectively define an opening therebetween communicating with the fluid passage of the body.

* * * * *